US007639929B2

(12) United States Patent
Baecker et al.

(10) Patent No.: US 7,639,929 B2
(45) Date of Patent: Dec. 29, 2009

(54) DEVICE COMPRISING A BOILER FOR GENERATING STEAM

(75) Inventors: Frank Baecker, Ruesselsheim (DE); Peter Anthes, Erbach (DE); Andreas Pabst, Darmstadt (DE)

(73) Assignee: Wella AG, Darmstadt (DE)

( * ) Notice: Subject to any disclaimer, the term of this patent is extended or adjusted under 35 U.S.C. 154(b) by 367 days.

(21) Appl. No.: 10/561,311

(22) PCT Filed: Jun. 28, 2004

(86) PCT No.: PCT/EP2004/006987

§ 371 (c)(1),
(2), (4) Date: Feb. 12, 2007

(87) PCT Pub. No.: WO2005/001337

PCT Pub. Date: Jan. 6, 2005

(65) Prior Publication Data

US 2008/0031602 A1 Feb. 7, 2008

(30) Foreign Application Priority Data

Jun. 27, 2003 (DE) ..... 103 29 139

(51) Int. Cl.
*A61H 33/12* (2006.01)

(52) U.S. Cl. ..... 392/403; 392/406

(58) Field of Classification Search ..... 392/403, 392/406

See application file for complete search history.

(56) References Cited

U.S. PATENT DOCUMENTS 3,086,534 A * 4/1963 Dalk et al. ..... 132/208
3,511,236 A * 5/1970 Peter et al. ..... 128/203.27
3,546,428 A * 12/1970 Omohundro ..... 392/404
3,581,529 A * 6/1971 Mitchell et al. ..... 68/222
3,645,007 A * 2/1972 Scott ..... 34/60
3,727,322 A * 4/1973 Walter et al. ..... 34/99
3,774,008 A * 11/1973 Maniscalco ..... 219/401
3,814,111 A * 6/1974 Doyle et al. ..... 132/272
4,314,138 A 2/1982 Itoh
4,553,339 A * 11/1985 Rigo ..... 34/99
5,010,905 A * 4/1991 Snyder et al. ..... 132/272
5,305,415 A * 4/1994 Stevens ..... 392/403
5,348,623 A * 9/1994 Salmon ..... 203/1

(Continued)

FOREIGN PATENT DOCUMENTS

EP 0 330 034 8/1989

(Continued)

*Primary Examiner*—Thor S Campbell
(74) *Attorney, Agent, or Firm*—Michael J. Striker

(57) ABSTRACT

The invention relates to a device (2) comprising a boiler (1) for generating steam, used for example in the steam-treatment of hair. The boiler (1), which is located in a recess (15) comprises a refill cap (3) and a steam outlet (4) in its upper region. The steam outlet (4) is situated in the upper lateral region (5) of the boiler (1). The boiler (1) is provided with an outflow opening (6) below the steam outlet (4), the lower edge (7) of the steam outlet (4) and the lower edge (8) of the outflow opening (6) defining a height (H) of a boiling chamber (W). The steam outlet (4) communicates with a steam conduit coupling (9) of a steam conduit (10) and the outflow opening (6) communicates with a sealing part (11) of the recess (15).

7 Claims, 5 Drawing Sheets

U.S. PATENT DOCUMENTS

| | | | | |
|---|---|---|---|---|
| 5,692,315 | A * | 12/1997 | Sham | 34/99 |
| 6,148,144 | A * | 11/2000 | Milanese | 392/405 |
| 7,028,348 | B2 * | 4/2006 | Tadaka et al. | 4/516 |
| 2004/0234254 | A1 * | 11/2004 | Czupich et al. | 392/403 |

FOREIGN PATENT DOCUMENTS

| | | |
|---|---|---|
| EP | 0 595 077 A1 | 5/1994 |
| FR | 2 707 734 | 1/1995 |
| GB | 2 158 210 A | 11/1985 |

* cited by examiner

DEVICE COMPRISING A BOILER FOR GENERATING STEAM

CROSS-REFERENCE TO RELATED APPLICATIONS

This is the US National Stage of PCT/EP04/06987, filed on 28 Jun. 2004, and claims priority under 35 U.S.C. 119(a)-(d) to German Patent Application No. DE 103 29 139.3, filed 27 Jun. 2003.

BACKGROUND OF THE INVENTION

1. Field of the Invention

The invention relates to a device having a boiler for generating steam.

2. Description of Related Art

One such device for steam treatment of hair is known from U.S. Pat. No. 4,314,138 A, for instance. In it, there is the risk that the boiler can become overfilled with water, which can cause an impairment in steam generation. It is in fact possible to fill the boiler up to a steam outlet opening, as a result of which boiling, bubbling water from the boiler is forced into the device and can even get into a treatment dome of the steam treatment device, with the possible risk of scalding a person to be treated.

It is therefore the object of the invention to create a device of this generic type that by simple provisions does not have this disadvantage.

BRIEF SUMMARY OF THE INVENTION

This object is attained by a device having a boiler for generating steam in which the boiler and other components are arranged such that, in operation of the device, there is always adequate boiling space available in the boiler used.

The invention will be described in further detail in terms of two exemplary embodiments.

DETAILED DESCRIPTION OF THE INVENTION

Figure 1:
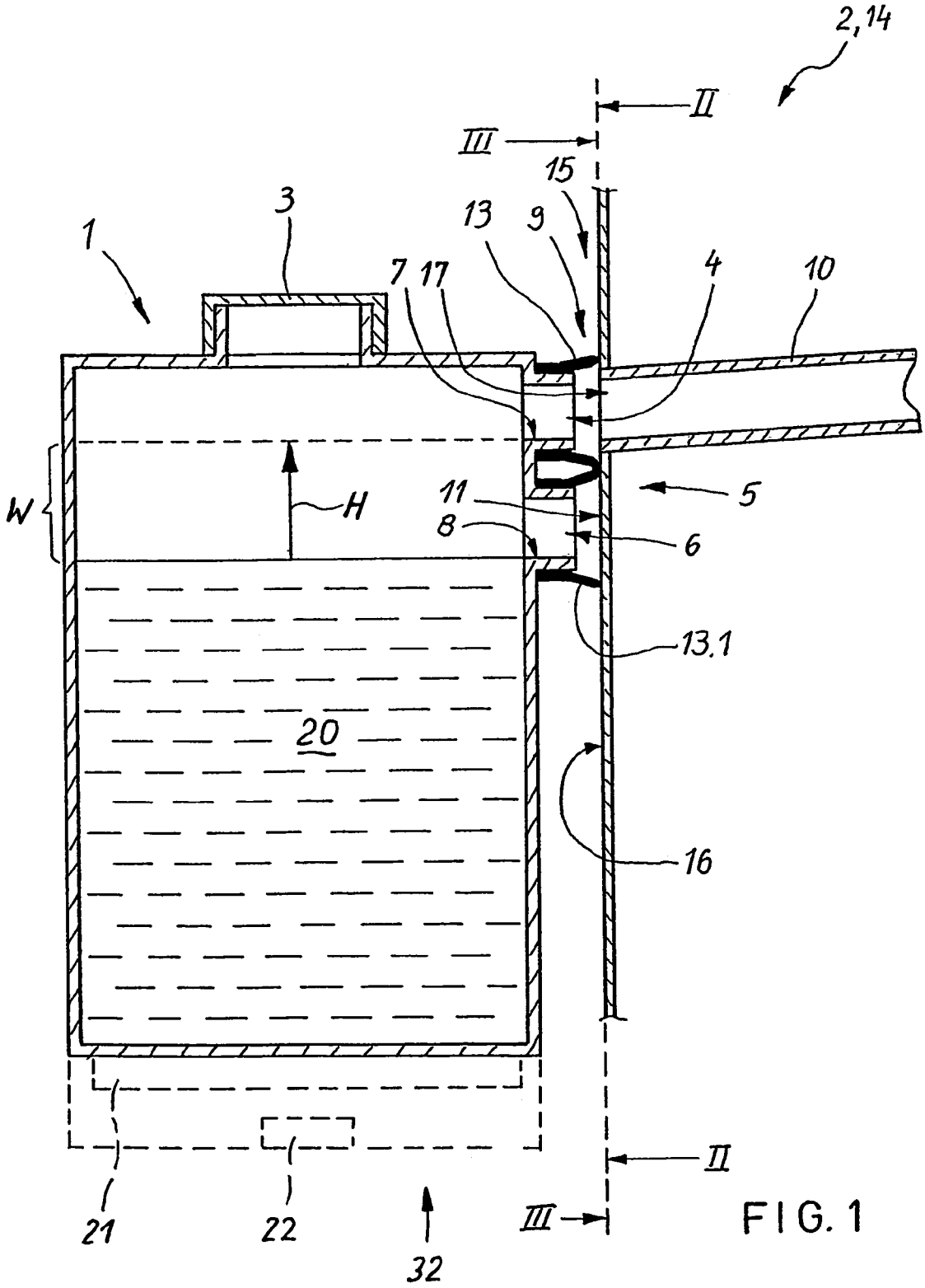
FIG. 1, a first exemplary embodiment of a device in a sectional side view, with a boiler and a steam conduit coupling.

FIG. 1 shows a device 2 with a boiler 1 for generating steam, for instance for a steam treatment of hair; the boiler 1 inserted into a receptacle 15 has a refill cap 3, located at the top, and a steam outlet opening 4. The steam outlet opening 4 is located in the upper lateral region 5 of the boiler 1. Below the steam outlet opening 4, the boiler 1 is provided with an outflow opening 6; a lower edge 7 of the steam outlet opening 4 and a lower edge 8 of the outflow opening 6 form a height H of a boiling space W, and the steam outlet opening 4 corresponds to a steam conduit coupling 9 of a steam conduit 10, and the outflow opening 6 corresponds with a closure part 11 of the receptacle 15.

By simple provisions, the closure part 11 is formed by an inner wall 16 of the receptacle 15.

The steam conduit coupling 9 and the steam outlet opening 4 and the outflow opening 6 are provided with an elastic seal 13, 13.1, so that given suitable dimensioning of the receptacle 15, a fluid-tight and pressure-proof steam conduit coupling 9 in relation to an inner wall 16 of the receptacle 15 is created as a sealing face.

For refilling the boiler 1, the boiler is removed from the receptacle 15, and via the cap 3, water 20 is introduced until it flows out of the outflow opening 6, resulting in a maximum fill height that is determined by the lower edge of the outflow opening 6. The boiler 1 is then inserted into the receptacle 15 again, as a result of which the outflow opening 6 is closed by the closure part 11, or by the inner wall 16. The result is necessarily an enlarged boiling space W that is required for seething, boiling water 20 during operation of the device 2; as a result, seething, boiling water 20 is prevented from spilling over into the device 2, thus averting a scalding injury.

Figure 2:
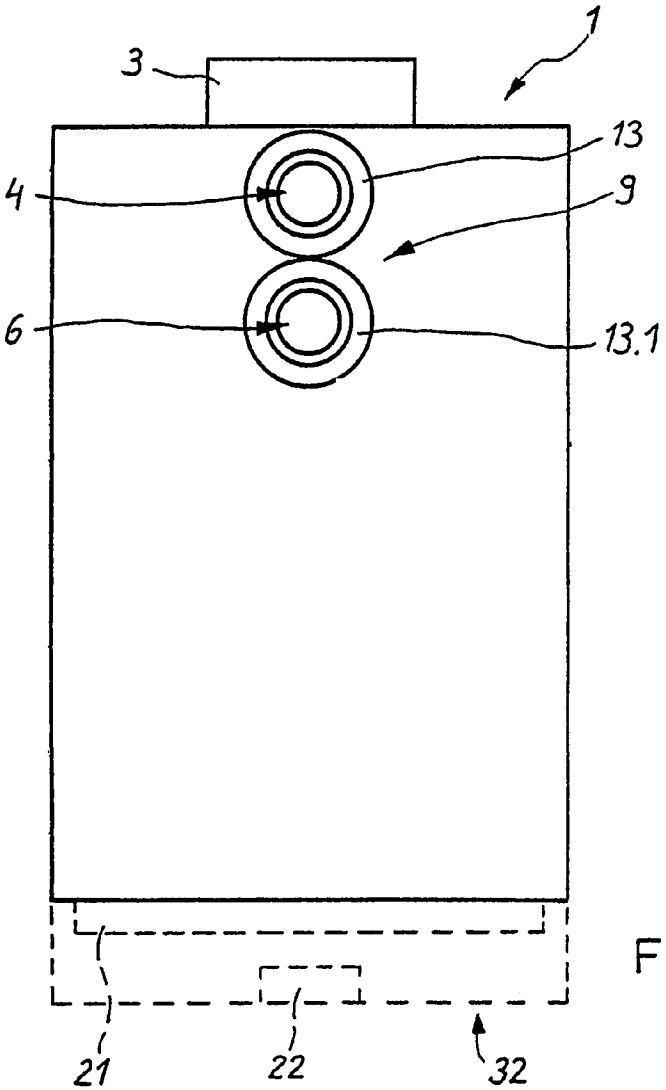
FIG. 2, a side view II-II on the device of FIG. 1.

FIG. 2 shows a side view II-II on the boiler 1 of FIG. 1, in which the seals 13, 13.1 are further seen in a plan view. The boiler 1 can selectively have a circular, rectangular, or elliptical cross-sectional area.

Figure 3:
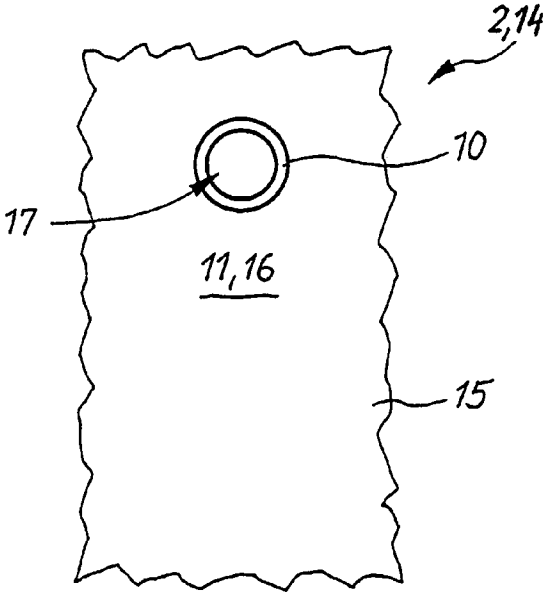
FIG. 3, a side view III-III on a steam conduit.

FIG. 3 shows a side view III-III on a steam conduit inlet 17 of the receptacle 15; the steam conduit inlet 17 is located in the plane of the inner wall 16 and corresponds with the steam outlet opening 4 of the seal 13. The outflow opening 6 is closed in fluid- or steam-tight fashion by the inner wall 16 of the receptacle 15, so that only steam from the steam outlet opening 4 can flow into the steam conduit inlet 17.

Figure 4:
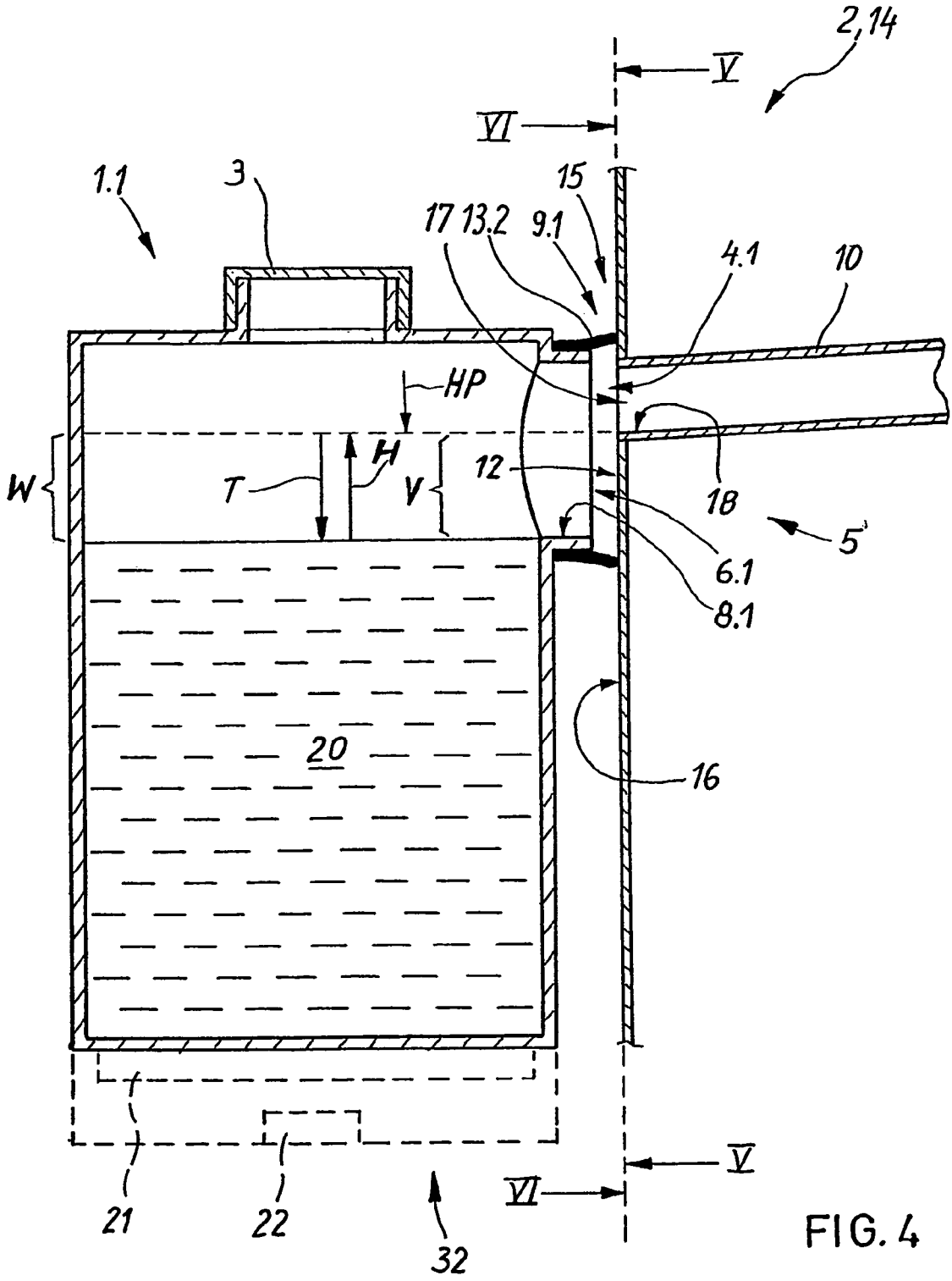
FIG. 4, a second exemplary embodiment of a device in a sectional side view, with a boiler and a steam conduit coupling.

FIG. 4 shows, as a second exemplary embodiment, a device 2 with a boiler 1.1 for generating steam, for instance for a steam treatment of hair, in which the boiler 1.1, inserted into a receptacle 15, has a refill cap 3.1 located at the top and a steam outlet opening 4.1. The steam outlet opening 4.1 is located in the upper lateral region 5 of the boiler 1.1. The steam outlet opening 4.1 is enlarged toward the bottom with a depth T, and the enlarged part V of the steam outlet opening 4.1 forms an outflow opening 6.1; the depth T forms a height H of a boiling space W; and a height point HP of the height H is predetermined by a lower edge 18 of a steam conduit inlet 17 of the steam conduit 10. Below the steam conduit inlet 17, a region 12 of an inner wall 16 of the receptacle 15 closes the outflow opening 6.1.

The steam conduit coupling 9.1 is provided with an elastic seal 13.2, whereupon a fluid-tight and pressure-proof connection in relation to the region 12 of the inner wall 16 of the receptacle 15 is created as a sealing face.

For refilling the boiler 1.1, the boiler is removed from the receptacle 15, and water 20 is introduced via the cap 3 until it flows out of the outflow opening 6.1, as a result of which a maximum fill height is created by a lower edge 8.1. This necessarily creates a boiling space W, which is necessary for seething, boiling water 20 during operation of the device 2. The boiler 1.1 is then inserted back into the receptacle 15, and below the steam conduit inlet 17, a region 12 of an inner wall 16 of the receptacle 15 closes the outflow opening 6.1.

Figure 5:
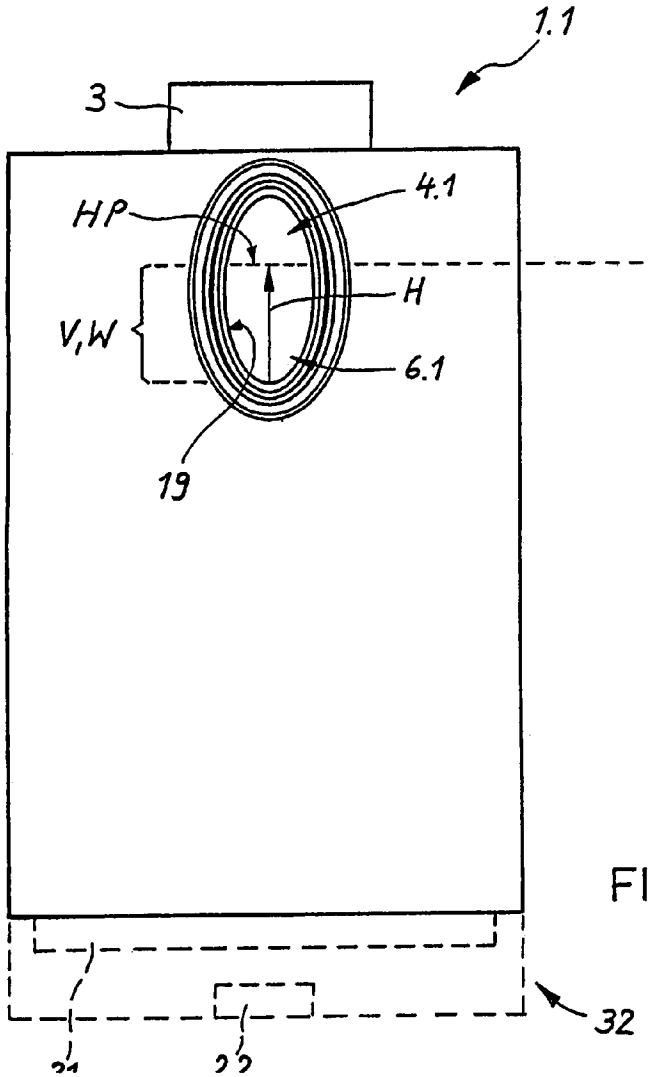
FIG. 5, a side view V-V on the device of FIG. 4.

FIG. 5 shows a side view V-V on the boiler of FIG. 4. The steam outlet opening 4.1 and the outflow opening 6.1 together have the shape of an upright ellipse 19, and as the seal 13.2, a sealing ring in the form of an ellipse 19 is provided.

Figure 6:
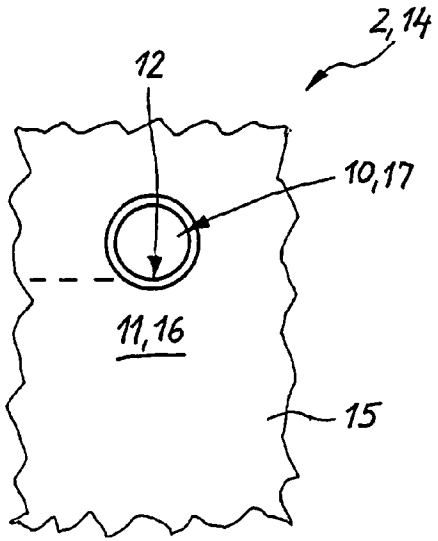
FIG. 6, a side view VI-VI on a steam conduit.

FIG. 6 shows a side view VI-VI on a steam conduit inlet 17; the steam conduit inlet 17 is located in the plane of the inner wall 16.

Figure 7:
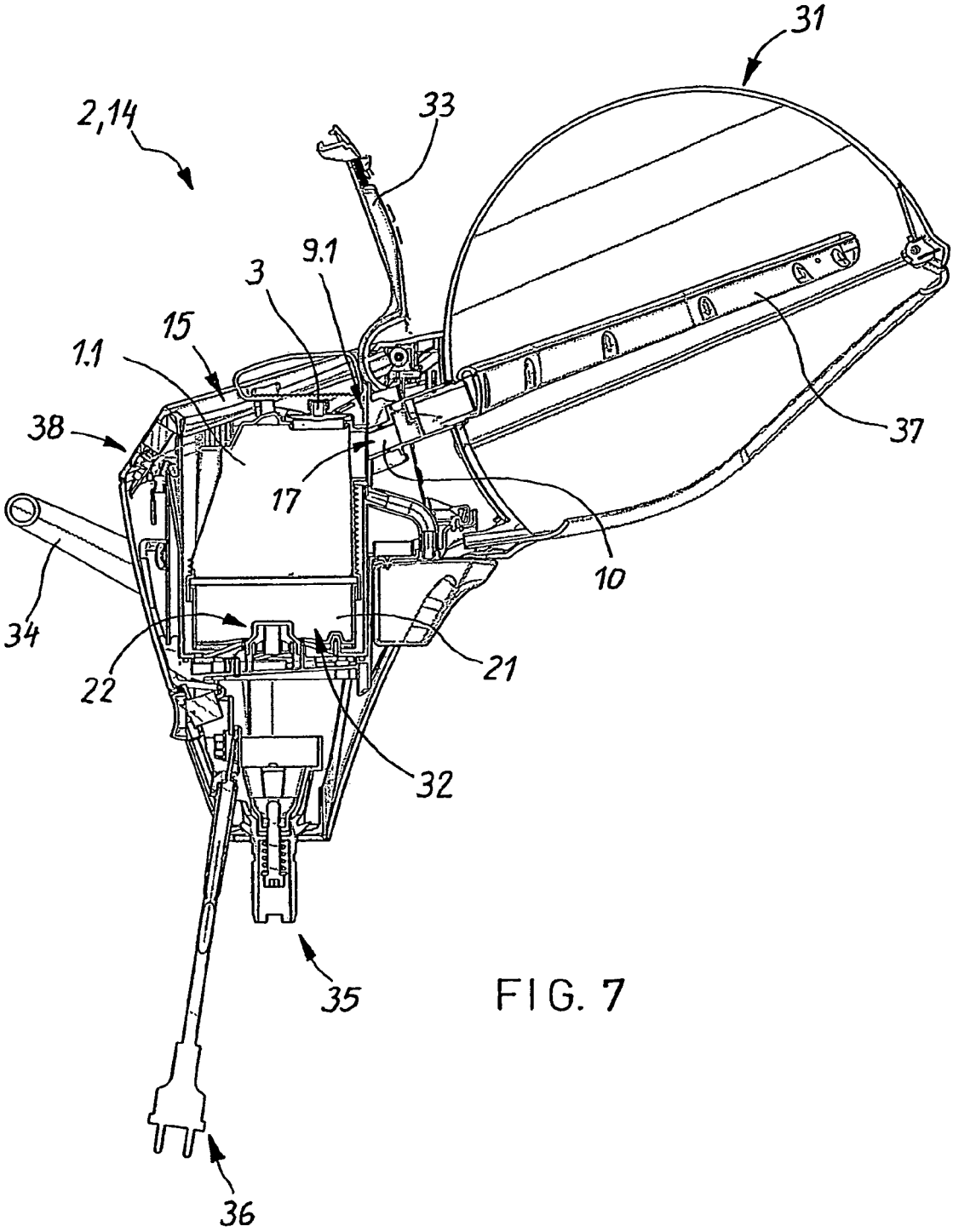
FIG. 7, in a complete view, the steam treatment device with a boiler of the second exemplary embodiment.

FIG. 7, in a complete view, shows a device 2, embodied as a steam treatment device 14 with a steam hood 31, for a steam treatment of hair; the steam hood 31 is provided with a steam distribution ring 37. In this exemplary embodiment, the boiler 1.1 is provided with an electric heater 21 and an electric coupling 22 as structural unit 32, which can be removed as a complete unit from the receptacle 15. In FIGS. 1, 2, 4 and 5, this structural unit 32 is suggested by dashed lines. The boiler 1, 1.1 is preferably produced economically of heat-resistant plastic and as a result can also be removed in its upper region without the risk of burning. A heat-insulated handle may selectively be provided as well. For fixing the boiler 1.1 in the receptacle 15, the steam treatment device 14 is provided with a swivel cap 33, which is shown in an open position. The steam treatment device 14 has a handle 34 for shifting the steam hood 31. A stand connection 35 is also provided, for connection to a flow-mounted stand, not shown, with which the steam treatment device 14 can also be adjusted in height. For supplying electrical energy, the steam treatment device 14 has a mains connection 36. A display panel/operator control panel 38 is provided for the operation of the steam treatment device 14.

LIST OF REFERENCE NUMERALS

1, 1.1 Boiler
2 Device
3, 3.1 Refill cap
4, 4.1 Steam outlet opening
5 Lateral region
6, 6.1 Outflow opening
7 Lower edge of steam outlet opening
8, 8.1 Lower edge of outflow opening
9, 9.1 Steam conduit coupling
10 Steam conduit
11 Closure part
12 Lower region
13, 13.1, 13.2 Seal
14 Steam treatment device
15 Receptacle
16 Inner wall
17 Steam conduit inlet
18 Lower edge of steam conduit inlet 17
19 Ellipse
20 Water
21 Electric heater
22 Electric coupling
31 Steam hood
32 Structural unit
33 Swivel cap
34 Handle
35 Stand connection
36 Mains connection
37 Steam distribution ring
38 Display panel/operator control panel
H Height
HP Height point
T Depth
V Enlarged part
W Boiling space

The invention claimed is:

1. A device having a boiler for generating steam, in which the boiler inserted into a receptacle has a refill cap, located at the top, and a steam outlet opening, wherein the steam outlet opening (4) is located in the upper lateral region (5) of the boiler (1); the boiler (1), below the steam outlet opening (4), is provided with an outflow opening (6), and a lower edge (7) of the steam outlet opening (4) and a lower edge (8) of the outflow opening (6) form a height (H) of a boiling space (W), and the steam outlet opening (4) corresponds to a steam conduit coupling (9) of a steam conduit (10), and the outflow opening (6) corresponds to a closure part (11) of the receptacle (15) and wherein the closure part (11) is formed by an inner wall (16) of the receptacle (15).

2. A device having a boiler for generating steam, in which the boiler inserted into a receptacle has a refill cap, located at the top, and a steam outlet opening, wherein the steam outlet opening (4.1) is located in the upper lateral region (5) of the boiler (1.1); the steam outlet opening (4.1) is enlarged toward the bottom with a depth (T), and the enlarged part (V) of the steam outlet opening (4.1) forms an outflow opening (6.1), and the depth (T) forms a height (H) of a boiling space (W), and a height point (HP) of the height (H) is predetermined by a lower edge (18) of a steam conduit inlet (17) of the steam conduit (10); the steam outlet opening (4.1) corresponds with a steam conduit coupling (9.1) of a steam conduit (10), and below the steam conduit inlet (17), a region (12) of an inner wall (16) of the receptacle (15) closes the outflow opening (6.1).

3. The device in accordance with claim 1 or 2, wherein the steam conduit coupling (9, 9.1) is provided with a seal (13, 13.1, 13.2).

4. The device in accordance with claim 2, wherein the steam outlet opening (4.1) and the outflow opening (6.1) together have a shape of an upright ellipse (19).

5. The device in accordance with claim 1 or 2, wherein as the device (2), a steam treatment device (14) is provided.

6. The device in accordance with claim 5, wherein the steam treatment device (14) is provided with a steam hood (31) for a steam treatment of hair.

7. The device in accordance with claim 1 or 2, wherein the boiler (1, 1.1) is provided with an electric heater (21) and an electric coupling (22) and is embodied as a structural unit (32).

* * * * *